United States Patent [19]

Spehrley, Jr.

[11] 4,184,622

[45] Jan. 22, 1980

[54] STAPLER HEAD

[75] Inventor: Charles W. Spehrley, Jr., Hanover, N.H.

[73] Assignee: Xerox Corporation, Stamford, Conn.

[21] Appl. No.: 922,609

[22] Filed: Jul. 7, 1978

[51] Int. Cl.[2] ..... B27F 7/06

[52] U.S. Cl. ..... 227/119; 227/123

[58] Field of Search ..... 227/1-6, 227/99, 100, 120, 119, 123, 127

[56] References Cited

U.S. PATENT DOCUMENTS

| | | | |
|---|---|---|---|
| 2,117,743 | 5/1938 | Polzer | 227/123 |
| 2,487,565 | 11/1949 | Leber et al. | 227/123 |
| 2,857,596 | 10/1958 | Allen et al. | 227/123 |
| 3,272,417 | 9/1966 | Howard et al. | 227/123 |
| 3,685,712 | 8/1972 | Turner et al. | 227/100 X |
| 3,934,778 | 1/1976 | Males | 227/123 |
| 3,946,927 | 3/1976 | Fehrs | 227/127 X |

*Primary Examiner*—Paul A. Bell

*Attorney, Agent, or Firm*—J. J. Ralabate; C. A. Green; H. Fleischer

[57] ABSTRACT

A stapling apparatus in which a staple is supported laterally as it is being driven into an article to prevent tilting thereof. The staple lateral support is retractable to facilitate removal of a jammed staple.

6 Claims, 4 Drawing Figures

STAPLER HEAD

The foregoing abstract is neither intended to define the invention disclosed in the specification, nor is it intended to be limiting as to the scope of the invention in any way.

BACKGROUND OF THE INVENTION

This invention relates generally to an electrophotographic printing machine, and more particularly concerns an improved stapling apparatus for use therein.

In the process of electrophotographic printing, a photoconductive member is charged to a substantially uniform level sensitizing the surface thereof. The sensitized photoconductive member is exposed to a light image of an original document being reproduced. Exposure of the sensitized photoconductive surface selectively discharges the charge in the irradiated areas to record an electrostatic latent image on the photoconductive surface corresponding to the informational areas contained within the original document. After the electrostatic latent image is recorded on the photoconductive surface, the latent image is developed by bringing a developer mix into contact therewith. Generally, the developer mix comprises carrier granules having toner particles adhering triboelectrically thereto. The greater attractive force of the electrostatic latent image causes the toner particles to be attracted from the carrier granules to the latent image. Thereafter, the toner powder image is transferred from the photoconductive surface to a copy sheet and permanently affixed thereto. This general approach was disclosed by Carlson in U.S. Pat. No. 2,297,691 and has been further amplified and described by many related patents in the art.

On many occasions, it is desirable to reproduce a set of original documents. Thus, it may be highly advantageous to produce a plurality of sets of copies with each set corresponding to the set of original documents. In an electrophotographic printing machine, a plurality of sets of copies may be formed by utilizing a recirculating document handling system in association with the printing machine. The recirculating document handling system is located on the exposure platen of the printing machine and advances successive original documents thereto. Each original document disposed on the platen is reproduced. After being copied, the original document is returned to the stack thereof so that it may be re-imaged for the next successive copying cycle. In this manner, collated sets of copies are formed. Frequently, the set of copy sheets are automatically stapled together. In high speed electrophotographic printing machines, it is highly desirable to minimize machine down time due to the stapler malfunctions. One type of stapler malfunction is the jamming of a staple in the throat or passageway thereof during the drive stroke. The causes of such jams are varied and principal among them is the occasional type wherein the legs of the staple move rearwardly into the passage as the crown is moved downwardly during the driving movement either because the legs do not properly enter into the drive track or they are somehow deflected rearwardly during the driving action. Another type of jamming occurs when the staple crown enters the guide track in a horizontally canted relation so a part adjacent one leg extends into the track and another part adjacent the other leg is still supported by the staple magazine. As the staple decends, the crown may be deformed into wedging engagement with the track with a portion thereof still being within the magazine. In any case, the removal of a jammed staple from the stapler head in a readily simple manner by the operator with a minimum amount of time expended therefor is highly desirable.

Accordingly, it is a primary object of the present invention to improve the jam clearance mechanism of a stapling apparatus employed in an electrophotographic printing machine.

Prior Art Statement

Various types of devices have hereinbefore been developed to improve the jam clearance of staple jams occurring in a stapler. The following prior art appears to be relevant:

Polzer U.S. Pat. No. 2,117,743, May 17, 1938
Howard et al. U.S. Pat. No. 3,272,417, Sept. 13, 1966
Males U.S. Pat. No. 3,934,778, Jan. 27, 1976

The pertinent portions of the foregoing prior art may be briefly summarized as follows:

Polzer describes a staple driving machine having a staple raceway with a yieldable front wall 49. A forwardly projecting pin 61 is mounted on the plunger adjacent its lower end. On depression of the plunger, pin 61 will force a jammed staple out of the raceway.

Howard et al. discloses a stapler having a jam proof staple magazine and guide. If the staple is deformed, plate 64 will yield to accommodate the width of the deformed staple or the combined width of the staple and driver 52. Downward movement of driver 52 will eject the staple through the lower end of throat 76.

Males describes a stapler nose piece assembly 14, a movable rigid member 22, and two stationary rigid members 24 and 26. When a staple jam occurs, movable member 22 pivots upwardly from the locked position to the unlocked position. When member 22 is in its unlocked open access position, a staple jam may be readily cleared from the open drive track.

It is believed that the scope of the present invention, as defined by the appended claims, is clearly patentably distinguishable over the foregoing prior art taken either singly or in combination with one another.

SUMMARY OF THE INVENTION

Briefly stated, and in accordance with the present invention, there is provided a stapling apparatus.

Pursuant to the features of the invention, the stapling apparatus includes means for driving a staple into an article. Means are provided for supporting laterally the staple being driven into the article to prevent tilting of the staple. Means retract the staple lateral support to facilitate removal of a jammed staple.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
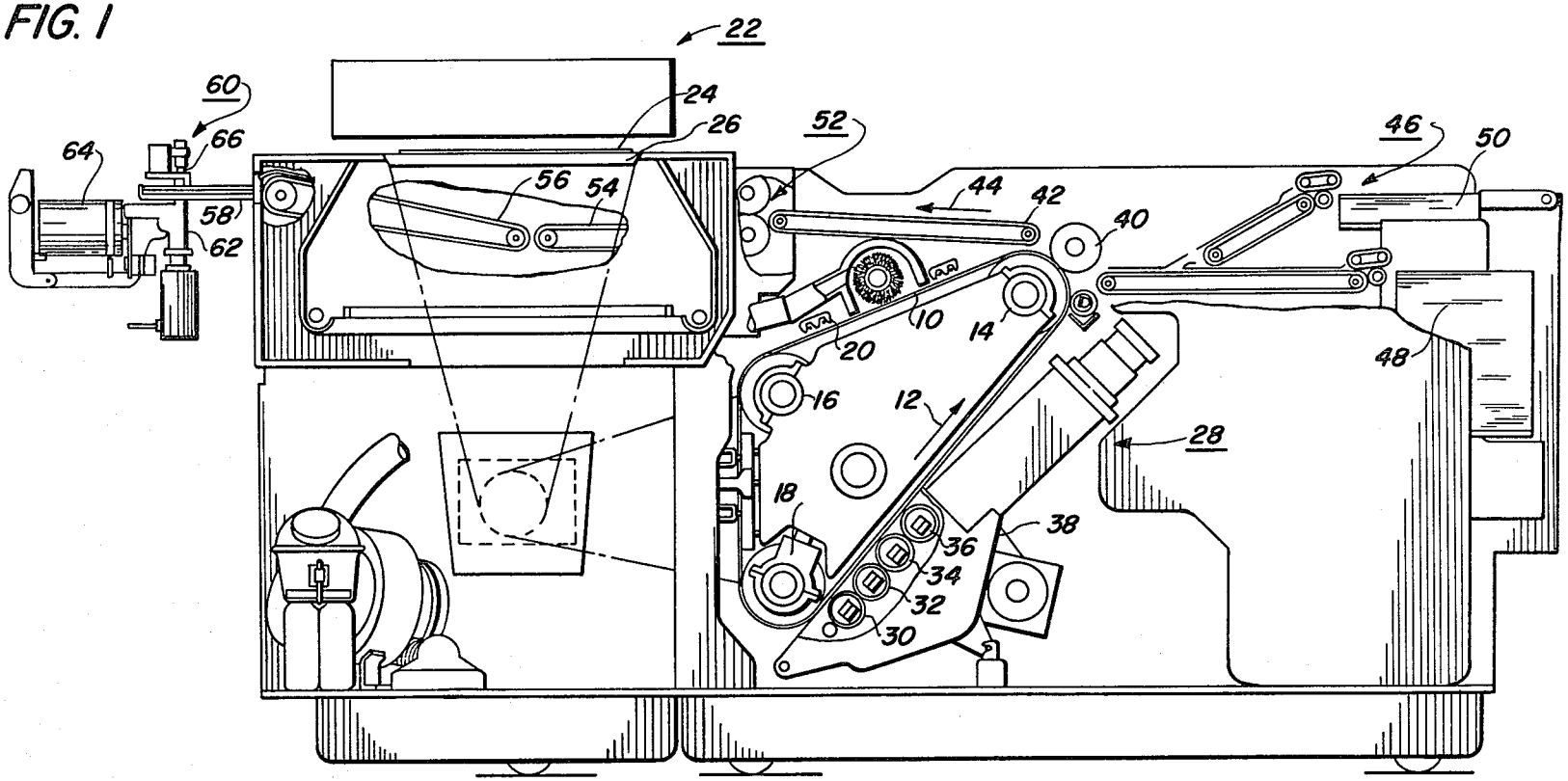
FIG. 1 is a schematic elevational view of an electrophotographic printing machine incorporating the features of the present invention therein.

In order to more fully understand the illustrative electrophotographic printing machine incorporating the features of the present invention therein, reference is made to the drawings. In the drawings, like reference numerals have been used throughout to designate identical elements. FIG. 1 schematically illustrates the various components of an electrophotographic printing machine employing the stapling apparatus of the present invention therein. Although the stapling apparatus is particularly well adapted for use in an electrophotographic printing machine, it will become evident from the following discussion that it is equally well suited for use in a wide variety of machines and is not necessarily limited in its applications to the particular embodiment shown herein.

Inasmuch as the art of electrophotographic printing is well known, the various processing stations employed in the FIG. 1 printing machine will be shown hereinafter schematically, and their operation described briefly with reference thereto.

With continued reference to FIG. 1, the electrophotographic printing machine employs a belt 10 having a photoconductive surface deposited on a conductive substrate. Preferably, the photoconductive surface is made from a selenium alloy with the conductive substrate being made from aluminum. Belt 10 moves in the direction of arrow 12 to advance sequentially through the various processing stations positioned about the path of movement thereof. Rollers 14, 16, and 18, support belt 10 movably. A drive mechanism, such as a suitable motor, is coupled to roller 14 for advancing belt 10 in the direction of arrow 12.

Initially, a portion of the photoconductive surface of belt 10 passes through charging station A. Preferably, charging station A includes a corona generating device, indicated generally by the reference numeral 20, for charging the photoconductive surface to a relatively high substantially uniform potential. A suitable corona generating device is described in U.S. Pat. No. 2,836,725 issued to Vyverberg in 1958.

Thereafter, the charged portion of the photoconductive surface is advanced by belt 10 through exposure station B. At exposure station B, a recirculating document handling system 22 advances successive original documents 24 to an exposure platen 26 and returns each original document to the stack thereof. Preferably, recirculating document handling system 22 is of the type described in British Pat. No. 1,492,466, the relevant portions thereof being incorporated into the present application. In operation, original document 24 is positioned face down upon platen 26 and a lamp flashes light rays thereupon. The light rays are reflected from original document 24 and transmitted through the optics of the exposure system forming a light image containing the informational areas thereof. The printing machine optics, i.e. a suitable lens and mirrors, project the light image onto the charged portion of the photoconductive surface. In this manner, the charged portion of the photoconductive surface is discharged selectively by the light image of the original document. This records an electrostatic latent image on the photoconductive surface of belt 10 which corresponds to the informational areas contained within original document 24.

Next, belt 10 advances the electrostatic latent image recorded thereon to development station C. Development station C includes a developer unit 28 having a plurality of magnetic brush developer rollers 30, 32, 34, and 36 disposed in housing 38. These developer rollers advance the developer mix into contact with the electrostatic latent image recorded on the photoconductive surface of belt 10. In a magnetic brush development system, a chain-like array of developer mix extends in an outwardly direction from each developer roll to contact the electrostatic latent image. The latent image attracts the toner particles from the carrier granules forming a toner powder image on belt 10.

The toner powder image is advanced by belt 10 to transfer station D. Transfer station D is located at a point of tangency on belt 10 as it moves around roller 14. A transfer roller 40 is disposed at transfer station D with the copy sheet being interposed between roller 40 and belt 10. Transfer roller 40 is electrically biased to a suitable magnitude and polarity so as to attract the toner powder image from belt 10 to the surface of the copy sheet in contact therewith. After transferring the toner powder image to the copy sheet, conveyor 42 advances the copy sheet in the direction of arrow 44 to fixing station E.

Prior to proceeding with the remaining processing stations, the sheet feeding apparatus will be briefly described. Sheet feeding apparatus 46 advances, in seriatim, successive copy sheets from stack 48, or, in lieu thereof, stack 50. The machine programming enables the operator to select the desired stack from which the copy sheet will be advanced. This capability permits the operator to select the copy sheet size. The selected copy sheet is advanced to transfer station D where the toner powder image adhering to belt 10 is transferred thereto.

After the toner powder image has been transferred to the copy sheet, conveyor 42 advances the copy sheet in the direction of arrow 44, to fixing station E. Fixing station E includes a fuser assembly, indicated generally by the reference numeral 52, having a heated fuser roller and a back-up roller. The copy sheet passes between the fuser roller and back-up roller with the toner powder image contacting the fuser roller. In this manner, the toner powder image is permanently affixed to the copy sheet. After fusing, conveyors 54 and 56 advance the copy sheet to finishing station F.

Finishing station F includes an output tray 58 and a stapling apparatus 60. The stapling apparatus may include a plurality of staplers each of which is manually adjustable to discrete positions corresponding to the copy sheet size used in the printing machine. Either or both staplers may be selected for the stapling operation. Inasmuch as all of the staplers are identical to one another, only one stapler will be discussed hereinafter. The detailed structure of the stapler will be described with reference to FIGS. 2 through 4, inclusive. After all of the original documents have been reproduced, the stack of copy sheets in tray 58 are stapled to one another by stapling apparatus 60. Though only one tray 58 is shown, it is representative of a plurality of trays wherein each tray may have a set of copy sheets therein corresponding to the set of original documents being reproduced. After each set of copy sheets has been stapled, the operator removes the finished sets from tray 58.

With continued reference to FIG. 1, stapling apparatus 60 comprises a stapler head 62 having a stick of staples 69 therein. A turret-like storage housing 64 automatically advances successive sticks of staples into stapler head 62. During the stapling apparatus, a pneumatic system drives clamper 66 into contact with the stack of sheets in tray 58 holding them fixedly in position. Thereafter, the pneumatic system actuates stapler 62 to drive a staple through the clamped stack of sheets. A clinching mechanism (not shown) bends the staple legs into contact with the stack of sheets in tray 58 forming a completed set of stapled copy sheets.

It is believed that the foregoing description is sufficient for purposes of the present application to illustrate the general operation of an electrophotographic printing machine incorporating the features of the present invention therein.

Figure 2:
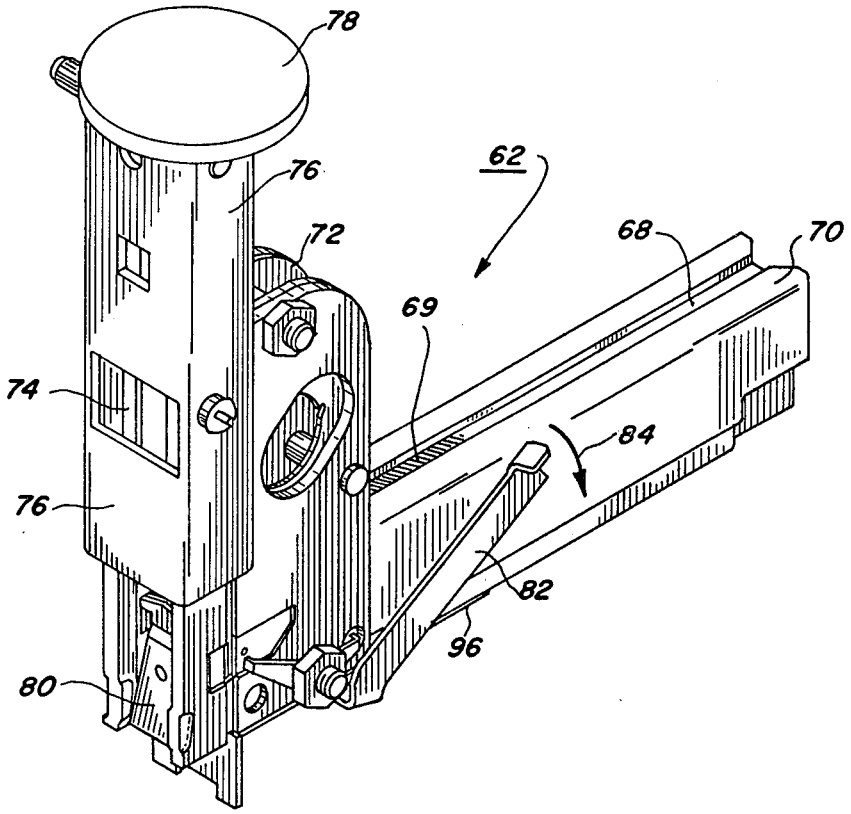
FIG. 2 is a perspective view depicting the stapler head used in the FIG. 1 printing machine.

Referring now to the specific subject matter of the present invention, FIG. 2 depicts the stapler head 62 employed in the FIG. 1 printing machine. Preferably, stapler head 62 is of a type described in U.S. Pat. No. 1,907,849 issued to Maynard in 1933, the relevant portions thereof being hereby incorporated into the present application. Stapler head 62 comprises a bar 68 of a substantially rectangular cross section comprising a staple-core 68 across which staples are straddled and adapted to slide forwardly thereon. Sheet metal sides 70 are welded or otherwise suitably attached to the sides of staple core 68 with the upper portions thereof folded across the top in a spaced relationship to form a magazine in which the staples are held. A pair of generally planar side plates 72 are riveted or otherwise suitably attached to opposed sides of the forward end of staple core 68. A staple pusher (not shown) straddles the top of staple core 68 and is resiliently urged into engagement with the trailing end of staple stick 69 so as to advance the staples forwardly into a driving position. A staple plunger 74 and housing 76 are guided slidably in vertical slots on the drive track in side plates 72. Knob 78 is attached to housing 76. As is usual in stapling machines of the present type, staple stick 69 advances on core 68 through a passageway defined by opposed channels on the inner surfaces of side plates 72. The leading staple is resiliently urged into the drive track defined by opposed slots in side plates 72. As plunger 74 decends, it shears the leading staple from stick 69 and moves it downwardly in the drive track toward the articles to be stapled, i.e. the stack of copy sheets. Staple lateral support 80 is resiliently urged into engagement with the decending staple and plunger to provide side support for the staple preventing tilting or canting thereof. After knob 78 has been depressed sufficiently to drive the staple through the stack of copy sheets, a spring resiliently urges knob 78, plunger 74, and housing 76 to return to their initial position. This permits the next successive staple to be resiliently urged into the drive track preparatory for being driven through the next set of copy sheets. Lever arm 82 is coupled to staple support 80. As is shown in FIG. 2, lever arm 82 is mounted pivotably on side plate 72. When the operator depresses lever arm 82, in the direction of arrow 84, support 80 is retracted. This permits a jammed staple to be readily removed from the drive track or to be driven therefrom by moving plunger 74 through the track.

Figure 3:
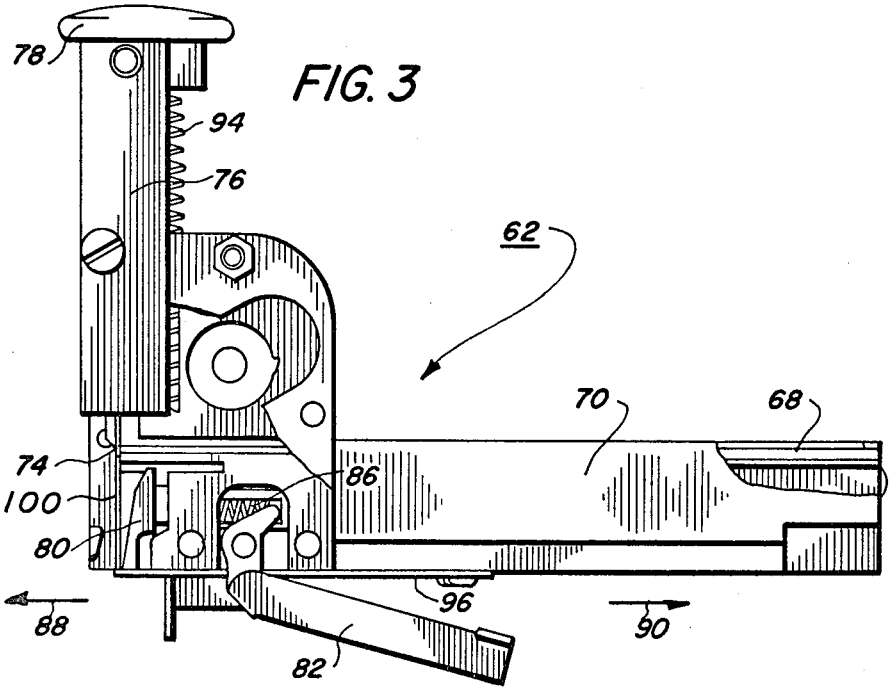
FIG. 3 is an elevational view illustrating the FIG. 2 stapler head with the staple lateral support retracted.

Turning now to FIG. 3, there is shown stapler head 62 with lever arm 82 pivoted downwardly retracting staple support 80. As is shown thereat, spring 86 resiliently urges staple support 80 in the direction of arrow 88 to support a staple being driven through drive track or slots 100 in side plates 72. Depression of lever arm 82 causes support 80 to move in the direction of arrow 90 spacing it from the drive track or slots 100. This permits plunger 74 to readily free a jammed staple. As plunger 74 decends, knob 78 compresses spring 94. After the staple has been driven through the set of copy sheets, spring 94, which has been compressed during the staple driving stroke, resiliently urged knob 78 and plunger 74 to return to their initial position.

Frequently, stapler 62 is positioned so that handle 78 is at the lowermost portion thereof, i.e. plunger 74 is driven upwardly rather than downwardly. In this environment, dirt particles may contaminate staple stick 69 and the mechanisms associated with stapler head 62. To prevent the foregoing from occurring, bonnet 96, i.e. a strip of sheet metal, is secured to undersurface 70 preventing particles from falling therein. This prevents contamination of stapler head 62.

Figure 4:
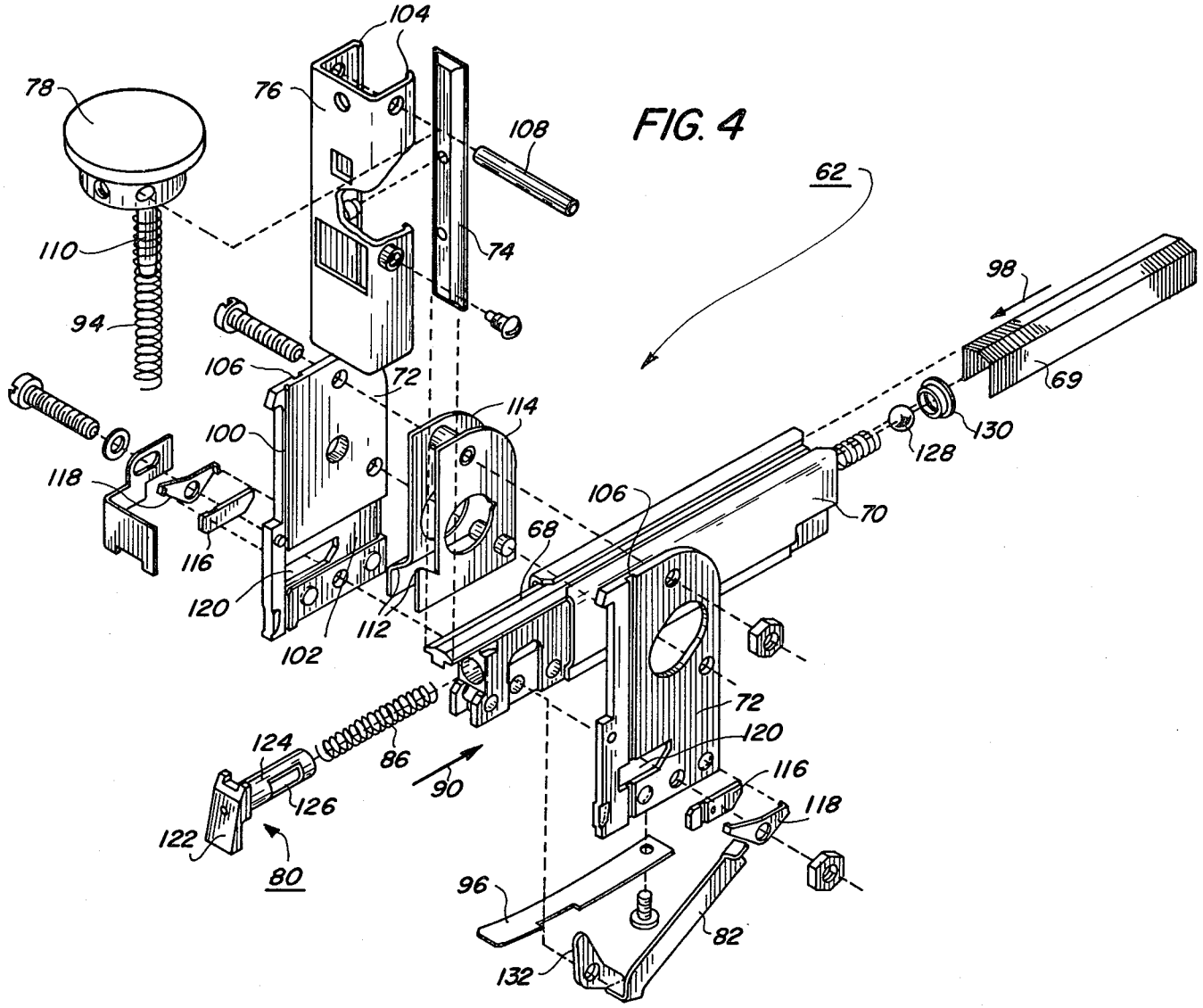
FIG. 4 is an exploded perspective view showing the FIG. 2 stapler head.

Referring now to FIG. 4, there is shown an exploded perspective view of stapler head 62. As illustrated thereat, staple core 68 has staples 69 straddled thereacross arranged to be advanced slidably thereon in the direction of arrow 98. Sheet metal sides 70 are attached to staple core 68. The upper portions of sheet metal sides 70 are folded across the top thereof in a spaced relationship to form a magazine in which staples 69 are held. Side plates 72 are attached to opposed sides of staple core 68. Each side plate 72 includes a vertical slot 100. When side plates 72 are secured to staple core 68, the pair of vertical slots 100 define a drive track for plunger 74. Each side plate 72 also has a channel 102 therein. Once again, when plates 72 are secured to staple core 68, channels 102 define a staple passageway through which staple stick 69 advances. The leading staple of stick 69 is resiliently urged into the drive track defined by slots 100. It should be noted that channels 102 are substantially normal to slots 100. Folded sheet metal housing 76 has inwardly projecting runners 104 which slide in grooves 106 in plates 72. Knob 78 is seated in the top of housing 76 and secured thereto by cross pin 108. Depending from the bottom of knob 78 is a pin 110 which projects through the upper coils of a helical spring 94, the lower end of the spring being supported on prongs 112 of plates 114. Plunger 74 is secured to housing 76 by means of a suitable rivet. Plunger 74 is formed with narrow fins on opposed side marginal regions which are received in slots 100 of plates 72. This enables plunger 74 and housing 76 to reciprocate. In one direction plunger 74 shears a staple from stick 69 and drives it through the stack of copy sheets and, in the opposite direction, returns to its initial position. Adapter plates 116 are resiliently urged into engagement with the side legs of staple stick 69 by flat springs 118. Plates 116 are mounted in cut-outs 120 in channels 102 of plates 72. Staple support 80 includes a shoe 122 and a cylindrical portion 124 integral therewith and extending normal to the surface of shoe 122. Cylinder 124 is formed from a tube having a cut-out portion 126 therein. Helical spring 86 has one end portion thereof interfit into the interior of tube 124. The other end portion of helical spring 86 is secured in position by a ball 128 and a nut 130 in threaded engagement with the rear end of staple core 68. Lever arm 82 is secured pivotably to core 68. The leading end portion 132 of lever arm 82 extends inwardly and mates with cut-out 126 of cylinder 124. In this way, pivoting of lever arm 82 in a downwardly direction causes staple support 80 to move in the direction of arrow 90 compressing spring 86. Movement of staple support 80 in the direction of arrow 90 retracts the surface of shoe 122 from the drive track defined by slots 100. It is evident that under these circumstances, a jammed staple may be readily removed from the drive track. This may be achieved by its falling under the influence of gravity from the drive track or, in lieu thereof, by depressing knob 78 so as to cause plunger 74 to force any jammed staple from the drive track. Inasmuch as shoe 122 no longer is pressing against the jammed staple, the staple will be readily freed therefrom.

Bonnet 96 is secured fixedly to the underside of core 68 preventing particle contamination thereof.

In recapitulation, it is apparent that the electrophotographic printing machine heretofore described employs a stapling apparatus having a stapler head with an improved jam clearance mechanism. The jam clearance mechanism is operator actuatable and moves the shoe which provides lateral support for the staple from the drive track permitting the ready freeing of a jammed staple therefrom. In addition, a sheet metal bonnet prevents particles from contaminating the stapler head during the operation thereof. This is particularly significant in an electrophotographic printing machine environment wherein toner particles and dust from copy sheets frequently result in stapler contamination. Thus, the improved stapling apparatus comprises not only a jam clearance mechanism, but, in addition thereto, a structure for preventing particle contamination thereof.

It is, therefore, evident that there has been provided, in accordance with the present invention, an improved stapling apparatus that fully satisfies the objects, aims, and advantages hereinbefore set forth. While this invention has been described in conjunction with a specific embodiment thereof, it is evident that many alterations, modifications, and variations will be apparent to those skilled in the art. Accordingly, it is intended to embrace all such alternatives, modifications, and variations that fall within the spirit and broad scope of the appended claims.

What is claimed is:

1. A stapling apparatus, including:

means for driving a staple into an article, said driving means comprises a pair of planar members, each of said planar members having therein a slot with a channel substantially normal to and in communication therewith, a magazine interposed between and having said pair of planar members secured thereto with opposed slots therein being substantially aligned with one another to define a drive track and opposed channels therein being substantially aligned with one another to define a staple passageway, said magazine supporting movably a stick of staples so that successive lead staples advance through the staple passageway into the drive track, and a plunger mounted slidably in the drive track for reciprocating movement with movement in a first direction being adapted to drive a staple into the article and movement in a second direction opposed thereto being adapted to return said plunger to the initial position thereof;

means for supporting laterally the staple being driven into the article to prevent tilting of the staple, said supporting means comprises a shoe arranged to move slidably in a direction substantially normal to the direction of movement of said plunger, and means for urging resiliently said shoe toward the drive track so as to provide lateral support for a staple moving therethrough; and means for retracting the shoe of said supporting means to facilitate removal of a jammed staple.

2. An apparatus as recited in claim 1, wherein said retracting means includes an operator actuatable lever arm having one end portion thereof coupled to said shoe so that moving said lever arm spaces said shoe from the drive track permitting a jammed staple to be readily removed therefrom.

3. An apparatus as recited in claim 2, further including means for preventing particles from contaminating the stick of staples in said magazine.

4. A reproducing machine for producing stapled sets of copies from a set of original documents with each original document being advanced from a supply station to an exposure platen and then returned to the supply station in repeated cycles, wherein the improved stapling apparatus includes:

means for driving a staple into the set of copies, said driving means comprises a pair of planar members, each of said planar members having therein a slot with a channel substantially normal to and in communication therewith a magazine interposed between and having said pair of planar members secured thereto with opposed slots therein being substantially aligned with one another to define a drive track and opposed channels therein being substantially aligned with one another to define a staple passageway, said magazine supporting movably a stick of staples so that successive lead staples advance through the staple passageway into the drive track, and a plunger mounted slidably in the drive track for reciprocating movement with movement in a first direction being adapted to drive a staple into the set of copies and movement in a second direction opposed thereto being adapted to return said plunger to the initial position thereof, means for supporting laterally the staple being driven into the set of copies to prevent tilting of the staple, said supporting means comprises a shoe arranged to move slidably in a direction substantially normal to the direction of movement of said plunger, and means for urging resiliently said shoe toward the drive track so as to provide lateral support for a staple moving therethrough; and means for retracting the shoe of said supporting means to facilitate removal of a jammed staple.

5. A reproducing machine as recited in claim 4, wherein said retracting means includes an operator actuatable lever arm having one end portion thereof coupled to said shoe so that moving said lever arm spaces said shoe from the drive track permitting a jammed staple to be readily removed therefrom.

6. A reproducing machine as recited in claim 5, further including means for preventing particles from contaminating the stick of staples in said magazine.

* * * * *